United States Patent [19]

Luke et al.

[11] Patent Number: 4,601,686

[45] Date of Patent: Jul. 22, 1986

[54] PRODUCTION OF TOBACCO-SMOKE FILTERS

[75] Inventors: John A. Luke, Eastleigh; David E. Sugars, Southampton, both of England

[73] Assignee: British-American Tobacco Company Limited, London, England

[21] Appl. No.: 343,442

[22] Filed: Jan. 28, 1982

[30] Foreign Application Priority Data

Feb. 18, 1981 [GB] United Kingdom ..... 81 05036

[51] Int. Cl.[4] ..... A24C 5/50; B65H 43/00

[52] U.S. Cl. ..... 493/43; 192/48.1; 192/150; 198/856; 221/21; 493/33

[58] Field of Search ..... 493/4, 31, 33, 43, 55; 192/48.1, 125 B, 125 R, 150, 0.032, 0.034; 53/77; 198/856; 221/10, 21

[56] References Cited

U.S. PATENT DOCUMENTS

| | | | |
|---|---|---|---|
| 867,288 | 10/1907 | Mueller | 221/10 X |
| 1,506,294 | 8/1924 | Faber | 221/10 |
| 1,996,341 | 4/1935 | McClelland | 192/55 |
| 2,108,165 | 2/1938 | Criley | 192/55 |
| 2,158,069 | 5/1939 | Grover | 198/856 |
| 2,273,451 | 2/1942 | Ricards | 198/856 X |
| 2,371,140 | 3/1945 | Alling et al. | 198/856 X |
| 2,589,220 | 3/1952 | Buckeridge | 198/856 X |
| 3,037,668 | 6/1962 | Jarrell | 198/856 X |
| 3,297,200 | 1/1967 | Andrews et al. | 221/10 X |
| 3,425,528 | 2/1969 | Perruca | 192/55 |
| 3,584,545 | 6/1971 | Ehlscheid | 493/33 |
| 3,643,780 | 2/1972 | Shimogaki et al. | 198/856 X |
| 3,688,467 | 9/1972 | Alexander | 53/77 |
| 4,020,973 | 5/1977 | Hinz | 221/21 X |
| 4,196,560 | 4/1980 | Seragnoli | 53/77 |
| 4,219,033 | 8/1980 | Horsewell et al. | 131/339 |
| 4,292,032 | 9/1981 | Luke | 493/43 |
| 4,436,517 | 3/1984 | Lebet | 493/43 X |

*Primary Examiner*—Rodney H. Bonck

*Attorney, Agent, or Firm*—Kane, Dalsimer, Kane, Sullivan and Kurucz

[57] ABSTRACT

The subject invention pertains to a device for operating upon a filter-rod lengths comprising a first conveyor for transferring the filter lengths from a supply outlet to a plurality of further conveyors. The further conveyors carry the filter lengths past a heat rod-forming elements and a barrier-depositing assembly. All the conveyors are driven from a single power source. The first conveyor may be selectively manually disengaged from the power source so that filter-rod lengths which have passed the first conveyor can be cleared from the device before the device is shut down.

5 Claims, 2 Drawing Figures

PRODUCTION OF TOBACCO-SMOKE FILTERS

Figure 1:
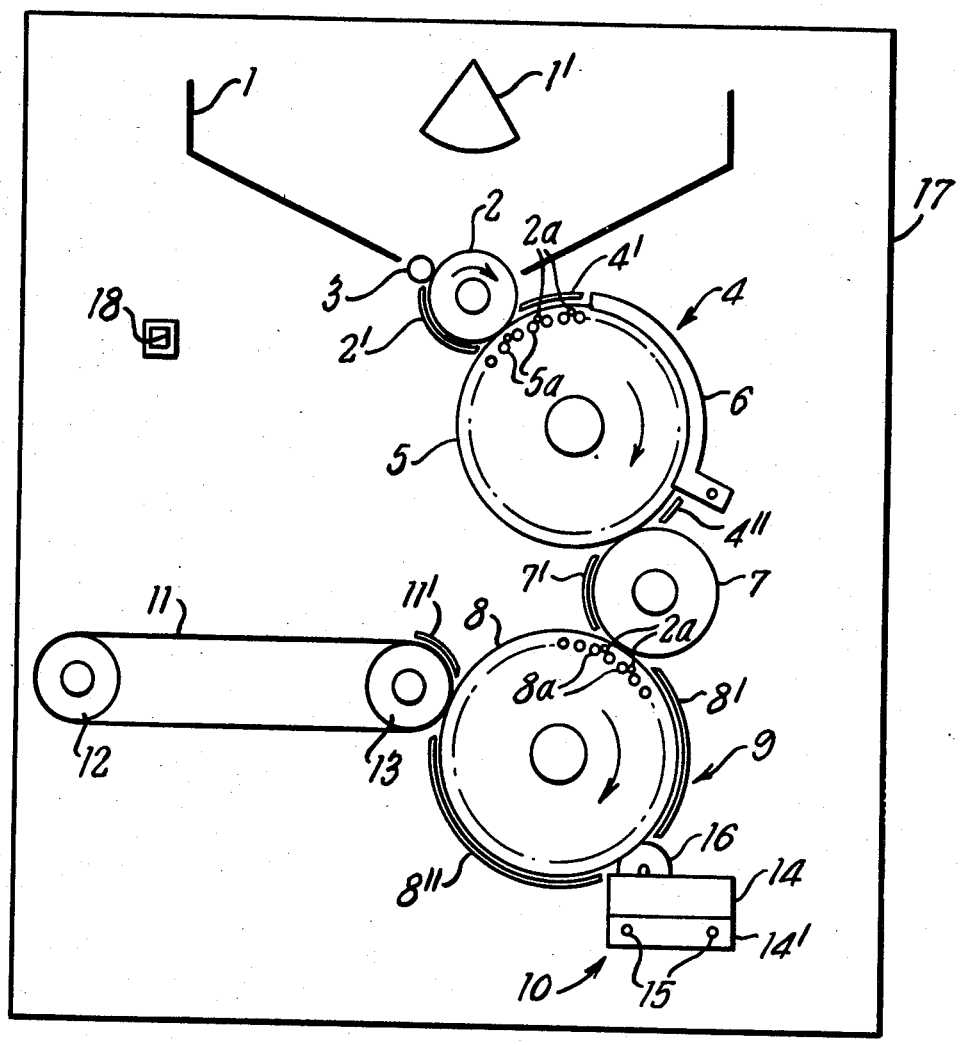

This invention concerns improvements relating to the production of tobacco-smoke filter components.

It is known, in apparatus for operating on cigarette filter rod lengths, for the rod lengths to be fed into a hopper and to be removed from a lower region thereof by means of a fluted drum or similar rotary conveying means. It is common for the fluted drum, which may be termed the hopper drum, to be followed by a plurality of further fluted drums, so arranged that the rod lengths are conveyed from one drum to the next. Various operations may be performed on the rod lengths whilst they are being conveyed by the drums.

Thus if, for example, the apparatus is a filter cigarette making machine, the rod lengths may whilst being conveyed on one of the drums be severed by cutters associated with that drum. Rod lengths fed to a filter cigarette making machine at a length six times that of a single filter element may be severed to give in each case three double length filter rods. Such double length rods are, whilst being conveyed by subsequent drums, spaced apart from each other and further manipulated to arrive at required relative positions before each double length rod is disposed between a pair of tobacco rods. Each group comprising a double length filter rod and two tobacco rods is then passed to a wrapping station at which a tipping is applied about the filter rod and adjacent portions of the tobacco rods. The resulting double length cigarettes are then, at another station, divided by cutting means into single cigarettes.

Apparatus for operating on cigarette filter rod lengths may also take the form of a filter rod forming machine.

In prior known such apparatus for operating on cigarette filter rod lengths, common drive means has been employed for driving the hopper drum and drums and other conveying means arranged to receive rod lengths as they pass from the hopper drum and sequentially to convey the rod lengths.

The present invention provides apparatus for operating on smoking article filter rod lengths, comprising supply means, a hopper for example, a conveyor disposed at an outlet of said supply means, and a plurality of further conveyors arranged for sequential conveyance of rod lengths passing from said first conveyor, and drive means operable to drive said first and said further conveyors, said drive means comprising manually activatable drive discontinuance means upon activation of which said first conveyor may be brought to or held at rest without discontinuance of the drive to further said conveyors.

If, in apparatus according to the invention, the drive means for driving a hopper conveyor and other conveyors includes a slipping clutch, jamming of rod lengths at the hopper outlet may cause activation of the slipping clutch, bringing all of the conveyors to rest. The operative can then attend to the removal of the jammed rod lengths and, if rod lengths on the further conveyors have been damaged by the condition finally resulting in the jamming at the hopper outlet, the operative can activate the drive discontinuance means before causing the slipping clutch to be re-engaged, whereby the rod lengths downstream of the hopper conveyor can be run out for disposal before the drive discontinuance means is deactivated and the supply of undamaged rod lengths from the hopper is thus resumed.

If the apparatus takes the form of a filter rod forming machine as disclosed in United Kingdom Patent Specification No. 2 033 207 A, the provision of the drive discontinuance means is advantageous in that, when it is required to discontinue the forming operation, the supply of rod lengths from the hopper may be stopped and then the rod lengths run out of the forming unit before the drive to that unit is discontinued. This avoids bringing the forming unit to rest with rod lengths remaining therein in contact with the heated formers of the unit.

The drive discontinuance means is also of convenience in the cleaning, maintenance and setting up of the apparatus.

Heretofore when it has been required to run a filter cigarette making machine or a filter rod forming machine without rod lengths passing from the hopper it has been known for the operative to insert a piece of sheet material into the hopper in such position as to prevent rod lengths coming into contact with the hopper conveyor. By use of the present invention such time consuming and inconvenient practice is avoided.

Figure 2:
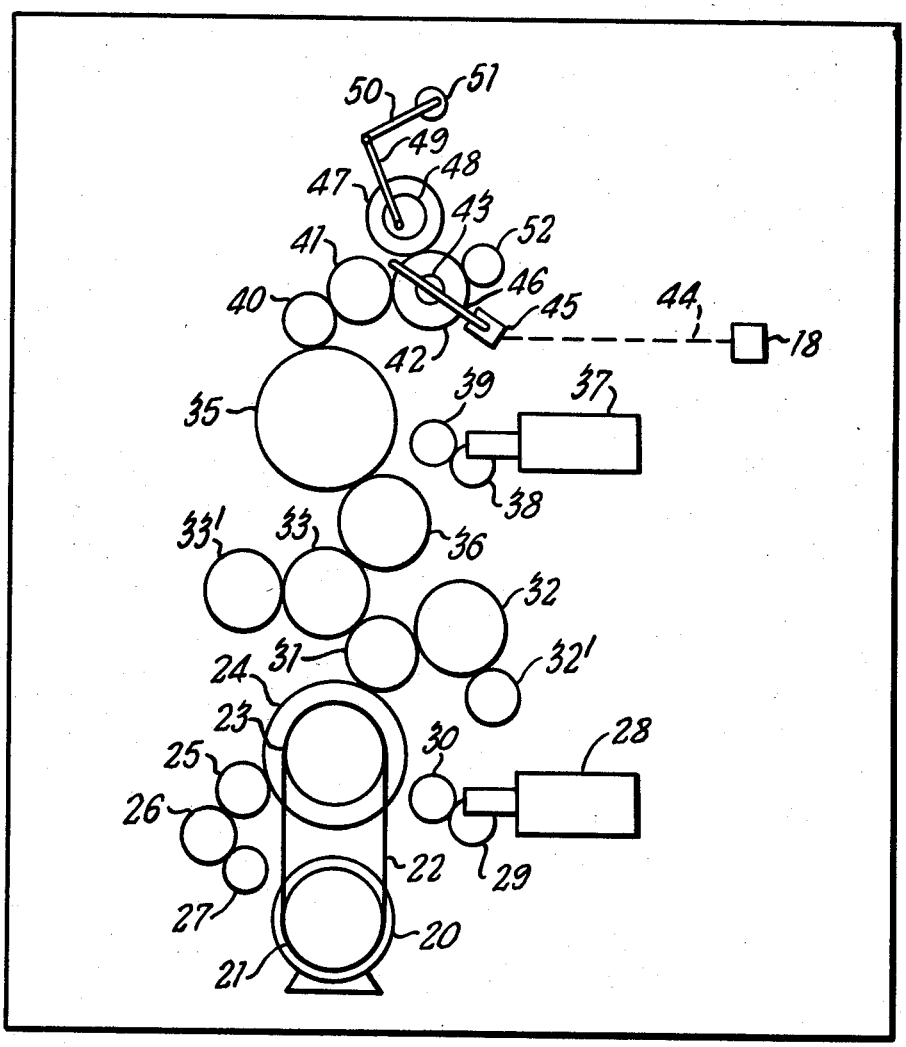

In order that the present invention may be clearly understood and readily carried into effect, reference will now be made, by way of example, to the accompanying diagrammatic drawings, in which:

FIG. 1 shows a front elevation of apparatus for operating on rod-shaped tobacco-smoke cigarette filter lengths; and FIG. 2 shows a rear elevation of the apparatus of FIG. 1.

Referring to FIG. 1, the apparatus there shown comprises a hopper 1 provided with an agitator 1'. In a lower opening of the hopper 1 is located a rotary conveyor in the form of a fluted drum 2 and, adjacent the drum 2, a smaller diameter refusal roller 3. The hopper drum 2 is operable to feed rod-shaped filter rod lengths *2a* from the hopper 1 to a rod forming unit 4 comprising a rotary conveying drum 5 and an arcuate former 6. A fluted transfer drum 7 is operable to receive rods from the drum 5 and to transfer them to a rotary conveying drum 8 of a barrier material deposition assembly 9 comprising a barrier material supply unit 10. The apparatus further includes an endless conveyor band 11 which is trained about a plain pulley 12 and a fluted pulley 13 and is arranged to receive filter rods from the drum 8. The apparatus may further include, downstream of drum 8, means for applying a wrapping, if desired.

Mounted around the periphery of the drum 5 are small diameter driven support rollers *5a* the axes of which are parallel to the axis of roller 5. Pairs of adjacent support rollers serve to rotate and support rod lengths *2a* fed from the hopper drum 2 while the rod lengths are carried through the rod forming unit 4 by the turning of the drum 5. The former 6 comprises radially inwardly projecting ribs (not shown) and heating means, preferably in the form of electrical elements.

The conveying drum 8 of the deposition assembly 9 is generally similar in construction to the drum 5 of the rod forming unit 4 and is provided with a similar series of peripheral driven support rollers *8a* for the continuous rotation and support of the rod lengths *2a* at the periphery of the drum 8.

Arcuate retaining members 2', 4', 4'', 7', 8', 8'' and 11' are associated with the drums 2, 5, 7 and 8 and the pulley 13. These retaining members serve to hold and guide the rod lengths in contact with the associated rotative members.

The barrier material supply unit 10 comprises a bath 14 for holding molten barrier material, the bath being slidably mounted on a block 14' which in turn is slidably mounted on two rods 15 fixedly secured in and extending perpendicularly to a wall member 17 of the apparatus. Thus the position of the bath 14 can be adjusted in a direction parallel to the axis of drum 8 and in a direction perpendicular thereto. Mounted on the bath 14 are applicator discs equivalent in number to the ribs on the former 6. One applicator disc, designated 16, is shown in FIG. 1.

Reference numeral 18 designates a push button further referred to below.

In FIG. 2 there are diagrammatically shown electric drive motors and associated gearing, mounted at the rear of wall member 17, which are operable, via shafts (not shown) journalled in the wall member 17, to drive the various above described components of the apparatus.

Towards the base of the wall member 17 there is mounted a main drive electric motor 20 keyed on the shaft of which is a drive pulley 21 arranged to drive, via a belt 22, a slipping clutch pulley 23 secured for rotation with a gear wheel 24. The slipping clutch pulley 23 and the gear wheel 24 are mounted on the shaft of the drum 8 of the deposition assembly 9. Thus, when the motor 20 is running, the drum 8 may be rotated in clockwise direction in FIG. 1. Meshing with the gear wheel 24 is an idler gear wheel 25 arranged to drive via a further idler gear wheel 26, a gear wheel 27. The gear wheel 27 is arranged to drive the applicator discs 16 via intermediate drive transmitting means (not shown). Adjacent the gear wheel 24 there is mounted on the wall member 17 an electric drive motor 28 operable to drive a gear wheel 30 via an intermediate gear wheel 29. The gear wheel 30 is mounted on a shaft via which a drive is provided to the support rollers **8*a* of the conveying drum 8**.

Also meshing with the gear wheel 24 is an idler gear wheel 31 which in turn meshes with an idler gear wheel 32 arranged to drive a gear wheel 32' mounted on the same shaft as the pulley 13. The gear wheel 31 also meshes with an idler gear wheel 33 which is arranged to drive a gear wheel 33' mounted on the shaft of the transfer drum 7. The gear wheel 33 drives a gear wheel 35 via an idler gear wheel 36. The gear wheel 35 is mounted on the same shaft as the conveying drum 5 of the rod forming unit 4, so as to rotate the drum 5 in a clockwise direction in FIG. 1. Adjacent the gear wheel 35 there is mounted on the wall member 17 an electric drive motor 37 arranged to drive a gear wheel 39 via a gear wheel 38. The gear wheel 39 is mounted on a shaft providing a drive to the support rollers **5*a* of the drum 5**.

Meshing with the gear wheel 35 is an idler gear wheel 40 arranged to drive a gear wheel 42 via an intermediate idler gear wheel 41. The gear wheel 42 is arranged to drive the hopper drum 2 via a clutch, indicated at 43, providing drive discontinuance means. The clutch 43 is activatable by means of the push button 18 which is electrically connected, by means indicated by broken line 44, to a solenoid 45 which is operatively connected to the clutch 43 by an activating bar 46. As may be seen from FIG. 2, the gear wheel 42 meshes with a gear wheel 47 keyed commonly on a shaft with a member 48 to which is eccentrically pivoted a connector link 49. The link 49 is connected to a pivot arm 50 fixedly secured to a shaft 51 mounting the agitator 1'. Thus, when the gear wheel 47 is caused to rotate, the shaft 51 assumes an angularly reciprocating motion.

The gear wheel 42 also meshes with a gear wheel 52 mounted on the same shaft as the refusal roller 3.

In operation of the apparatus, rod lengths six times the length of individual filter elements are fed into the hopper 1 and the bath 14 is charged with barrier material. With rod lengths of cellulose acetate, for example, the barrier material may be a hot melt material such as polyethylene, in which case the bath 14 is provided with heating means, preferably in the form of electrical elements.

The hopper drum 2 transfers rod lengths **2*a* one-by-one from the hopper 1 to the drum 5 of the unit 4. The refusal roller 3, rotating in an anti-clockwise direction, serves to ensure an even flow of the rod lengths from the hopper 1 to the hopper drum 2. As the rod lengths are carried by the drum 5, and rotated about their axes by the peripheral support rollers 5*a*, in contact with the hot ribs of the former 6, annular grooves, six in number, are formed in each of the rod lengths. The thus moulded rod lengths are then transferred by the drum 7 on to the drum 8 of the deposition assembly 9 where under action of the peripheral support rollers 8*a* each rod length is again rotated about its axis. The rod lengths are carried by the drum 8 to the barrier material supply unit 10, the arrangement being such that the applicator discs 16 extend partially into each one of the annular grooves formed in the rods. As the discs 16 revolve, lower portions thereof are immersed in the liquid barrier material in the bath 14**, and this barrier material is deposited in each of the grooves so as to produce in each groove an annular tobacco-smoke barrier.

Rod lengths passing from the deposition assembly 9 are transferred to the conveyor band 11.

The above described apparatus provides practical means for producing filter elements for use in filters as described in the specification of our U.S. Pat. Ser. No. 4,219,033.

By depressing the push button 18 the operative can cause discontinuance of rotative drive to the hopper drum 2, the refusal roller 3 and the agitator 1', whilst maintaining drive to the other components of the apparatus.

What is claimed is:

1. Apparatus for thermally operating upon smoking-article filter-rod lengths comprising supply means for the rod lengths, a first conveyor disposed at an outlet of said supply means, a plurality of further conveyors arranged for sequential conveyance of rod lengths passing from said first conveyor, at least one of said further conveyors being arranged for conveying said rod lengths past a heatable rod-forming means, drive means operable to drive said first and further conveyors, said drive means including a slipping clutch operable upon the occurrence of a rod jam to discontinue drive to said first and further conveyors, and manually activatable drive-discontinuance means, activation of which allows selective discontinuance of drive to said first conveyor, without discontinuance of, or with recontinuation of, the drive to said further conveyors.

2. Apparatus according to claim 1, wherein the said supply means comprises a hopper and the first-named conveyor is a rotary conveyor in the form of a fluted drum disposed at the outlet of the hopper.

3. Apparatus according to claim 2, wherein the said drive-discontinuance means is included in the drive to the drum.

4. Apparatus according to claim 1, wherein at least one said further conveyor is arranged for conveying the filter rod lengths past a barrier-material deposition assembly comprising a supply unit for the barrier material.

5. Apparatus according to claim 1, wherein the said drive means comprises a single source of power and gear transmission means provided, operatively, between the said source and the conveyors, the said drive-discontinuance means being disposed between the first-named conveyor and the said transmission means.

* * * * *